US005375966A

United States Patent [19]

Takemoto et al.

[11] Patent Number: 5,375,966

[45] Date of Patent: Dec. 27, 1994

[54] RESERVE TANK STRUCTURE FOR PACHINKO ISLAND

[75] Inventors: Takatoshi Takemoto; Toshikazu Chida; Yoshihide Kurihara, all of Tokyo, Japan

[73] Assignee: Kabushiki Kaisha Ace Denken, Tokyo, Japan

[21] Appl. No.: 993,868

[22] Filed: Dec. 23, 1992

[30] Foreign Application Priority Data

Dec. 24, 1991 [JP] Japan ..... 3-340996

[51] Int. Cl.[5] ..... A63F 7/02

[52] U.S. Cl. ..... 414/787; 273/121 B

[58] Field of Search ..... 414/162, 216, 288, 299, 414/403, 414, 787; 273/121 B, 121 D, 121 R, 124 R, 125 R, 127 C; 221/82, 124; 220/500

[56] References Cited

U.S. PATENT DOCUMENTS

| | | | |
|---|---|---|---|
| 1,726,603 | 9/1929 | Allen | 414/299 |
| 2,062,166 | 11/1936 | Delwiche | 273/125 R |
| 4,447,057 | 5/1984 | Hollésy | 273/125 R |
| 5,120,060 | 6/1992 | Parker et al. | 273/121 BX |

FOREIGN PATENT DOCUMENTS

| | | | |
|---|---|---|---|
| 0004337 | 1/1977 | Japan | 273/121 B |
| 0015742 | 2/1977 | Japan | 273/121 D |
| 0071946 | 6/1978 | Japan | 273/121 R |
| 0144232 | 11/1979 | Japan | 273/121 D |
| 4-317681 | 11/1992 | Japan | 273/121 B |
| 4312487 | 11/1992 | Japan | 273/121 B |

*Primary Examiner*—Michael S. Huppert
*Assistant Examiner*—James Keenan
*Attorney, Agent, or Firm*—Lowe, Price, LeBlanc & Becker

[57] ABSTRACT

In a reserve tank structure for supplying, to a collecting gutter mounted slantedly in a lower part of a pachinko island and communicating with a lower tank above which a polishing and lifting device is located, pachinko balls which have flowed over the polishing and lifting device, a reserve tank is divided into a plurality of tank parts arranged on a plane. These parts each have an inclined bottom surface and each includes, under a lower portion of the entire reserve tank, an inclined lower gutter communicating with the bottom surfaces of the individual tank parts and also communicating with the collecting gutter.

24 Claims, 9 Drawing Sheets

FIG. 4
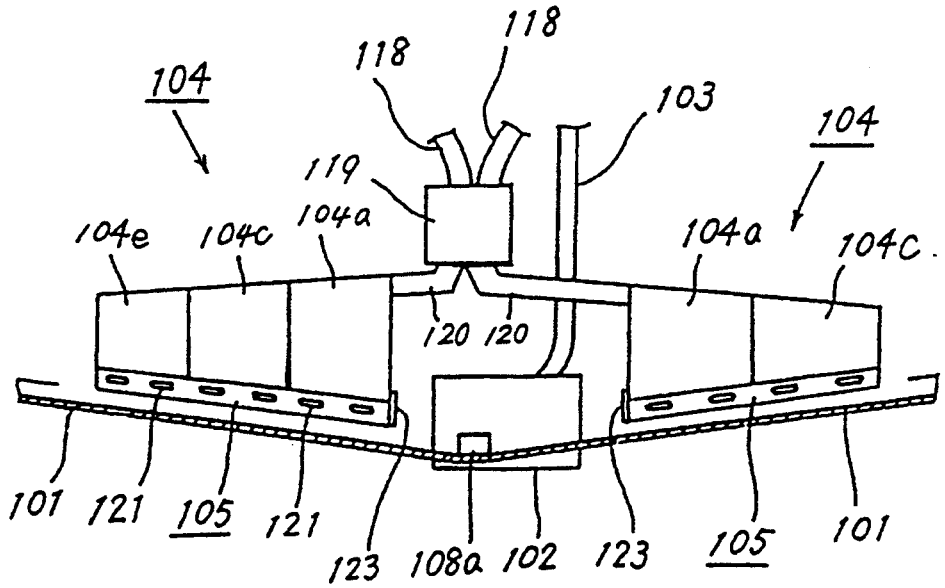
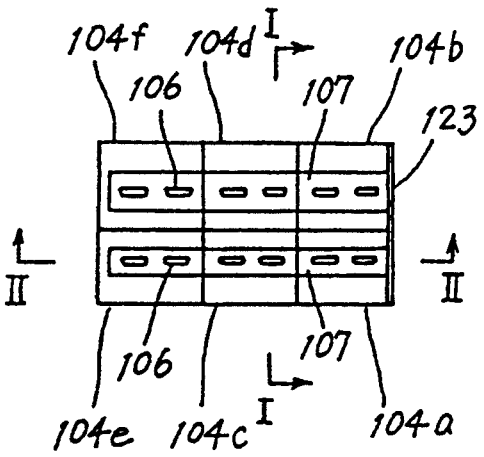
FIG. 5A
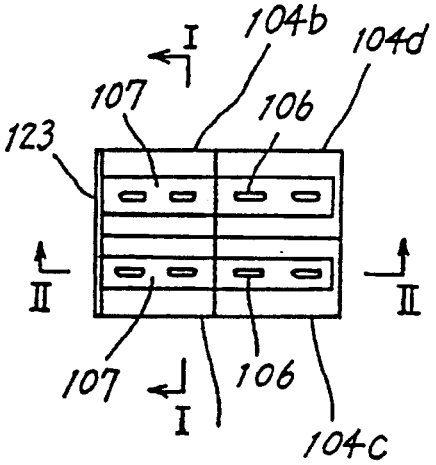
FIG. 5B

RESERVE TANK STRUCTURE FOR PACHINKO ISLAND

BACKGROUND OF THE INVENTION

1. Field of the Invention

This invention relates to a reserve tank structure for storing pachinko balls when those in a pachinko island of an amusement arcade are more than enough and for supplying the pachinko balls in stock to the pachinko island when those in the island are not enough.

2. Description of the Related Art

Conventionally, in an amusement arcade such as a pachinko parlor, a player throws the pachinko balls, which were received as prizes from the pachinko machine, into a ball counter to record the number of the pachinko balls such as on a receipt paper or a magnetic recording card, and then brings the receipt paper or magnetic recording card to an exchange counter for exchange with a premium. Meanwhile the pachinko balls put into the ball counter are collected to be redistributed to the individual pachinko machines and ball dispensers, thus being circulated through the island.

A circulation system for pachinko balls is currently known in which a polishing and lifting device is located above a lower tank communicating with a collecting gutter extending slantly in the lower part of the pachinko island so that pachinko balls flown over the polishing and lifting device can be supplied to a reserve tank communicating with the collection gutter. This known art is exemplified by our coassigned Japanese Patent Application No. Hei 3-85013, in which there is equipped with a large reserve tank having in its bottom an opening through which pachinko balls are to be supplied to the collecting gutter.

More specifically, as shown in FIG. 9 of the accompanying drawings, a plurality of pachinko islands 2 are provided in an amusement arcade 1 in parallel relationship with an aisle 3 between adjacent islands. On opposite sides of each pachinko island 2, a pair of arrays of pachinko machines 21 are installed with a ball dispenser 22 between adjacent pachinko machines 21, 21. In the center of each pachinko machine array, there is also installed a ball counter 51, which serves as a ball collector to collect the pachinko balls, which were received from outside the island as returned by players, into the island.

As shown in FIG. 10, there are in each pachinko island 2 upper and lower tanks 24, 31 for storing pachinko balls in the island. Each pachinko island 2 also has an upper path 25 extending over the individual pachinko machines 21 and ball dispensers 22 from the upper tank 24, and a lower path 26 extending under the individual pachinko machines 21 from the upper tank 24.

Downstream of the lower path 26, there is situated a polishing device. Thus in each pachinko island 2, pachinko balls in the upper tank 24 are supplied to the individual pachinko machines 21 via the upper path 25 and a ball supplier 123, and are also supplied to the individual ball dispensers 122 via the upper path 25 so that a quantity of pachinko balls according to the amount of money inserted by a customer can be dispensed to the customer. The pachinko balls inserted into the individual pachinko machines 21 by players, i.e. from outside the island, flow into the lower path 26. The pachinko balls collected from the ball counter 51 are discharged to the lower path 26, which serves as a ball collecting path, via the lower tank 31, and the pachinko balls collected from the lower path 26 are raised into the upper tank 24 by the polishing device 27.

The lower tank 31 is located below the upper tank 24 having in its bottom an opening from which pachinko ball are to be discharged to the lower path 26. In the opening 43 of the lower tank 31, there is located a shutter 44 for regulating the quantity of pachinko balls to be discharged from the lower tank 31.

The upper and lower tanks 24, 31 are connected with each other by an overflow tube 29 through which the pachinko balls which have overflowed from the upper tank 24 are transferred to the lower tank 31.

The packinko balls in the upper tank 24 are supplied to the individual pachinko machines 21 and the individual ball dispensers 22, and the pachinko balls inserted into the individual pachinko machines by players flow into the lower path 26. Meanwhile, the pachinko balls returned to the ball counter 51 from players flow into the lower path via the lower tank 31 after being counted by the ball counter 51. The pachinko balls collected from the lower path 26 are raised into the upper tank 24 by the polishing device 27, which polishes the pachinko balls while lifting. The pachinko balls overflown from the upper tank 24 are transferred to the lower tank 31 through the overflow tube 29. Thus pachinko balls are circulated in the pachinko island 2.

However, with the known arrangement, since the single large reserve tank has a large bottom surface, bridging of balls tends to occur on the bottom surface at the upper side away from the opening so that many pachinko balls will be not be discharged out of the reserve tank and then will stay there as dead balls. Consequently these remaining pachinko balls would finally be rust. Further, since a lot of pachinko balls are discharged at once to the collecting gutter, the pachinko balls in the collecting gutter would not flow smoothly and would tend to get clogged.

SUMMARY OF THE INVENTION

It is therefore a principal object of this invention to provide a reserve tank structure for storing pachinko balls when pachinko balls in a pachinko island are more than enough and supplying pachinko balls to the individual pachinko machines and the individual ball dispensers when pachinko balls in the island are not enough, in a streamlined circulation free from bridging.

According to this invention, there is provided a reserve tank structure for supplying, to a collecting gutter mounted slantedly in a lower part of a pachinko island and communicating with a lower tank above which a polishing and lifting device is located, pachinko balls which have flowed over the polishing and lifting device, wherein said reserve tank structure has a reserve tank divided into a plurality of tank parts arranged on a plane and each having an inclined bottom surface, and includes, under the entire reserve tank, an inclined lower gutter communicating with said bottom surfaces of the individual tank parts and also communicating with the collecting gutter.

The lower gutter may be divided transversely into a plurality of gutter parts arranged and communicating with the respective bottom surfaces of said tank parts.

The reserve tank structure may have a pair of identical reserve tanks which are adapted to be located above the associated collecting gutters at opposite sides of the lower tank and each of which is composed of said tank parts.

The tank parts may include a plurality of longitudinally successive pairs of tank parts, said tank parts of each pair being arranged transversely.

The reserve tank structure may further include a longitudinally inclined supply groove having a plurality of supply holes communicating with the respective tank parts upwardly thereof.

Each gutter part may have an inclined lower outlet adapted to be located above branched portions of the collecting gutter and to communicate with these branched portions, which communicate with the associated supply ports at opposite sides of the lower tank.

With this structure, when the pachinko balls which have overflowed from the upper part of the island are supplied to the supply groove, they are then supplied into all the individual tank parts from the respective supply openings for storage there. Since the bottom surface of each tank part is narrow and slanted, pachinko balls are discharged from the tank part to the associated gutter smoothly without bridging, and the pachinko balls are then supplied into the lower tank via the collecting gutter effectively.

BRIEF DESCRIPTION OF THE DRAWINGS

FIG. 4 is a front view of the reserve tank structure of FIG. 1;

FIG. 5 is a fragmentary plan view of FIG. 1;

DETAILED DESCRIPTION

Figure 1:
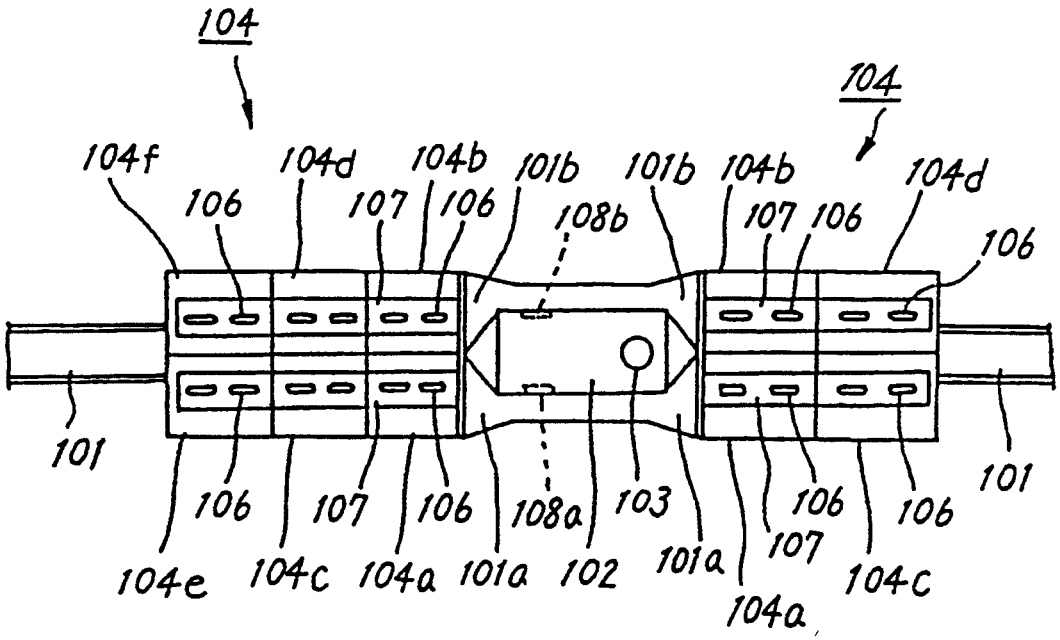
FIG. 1 is a fragmentary plan view of a reserve tank structure according to a preferred embodiment of this invention.
Figure 2:
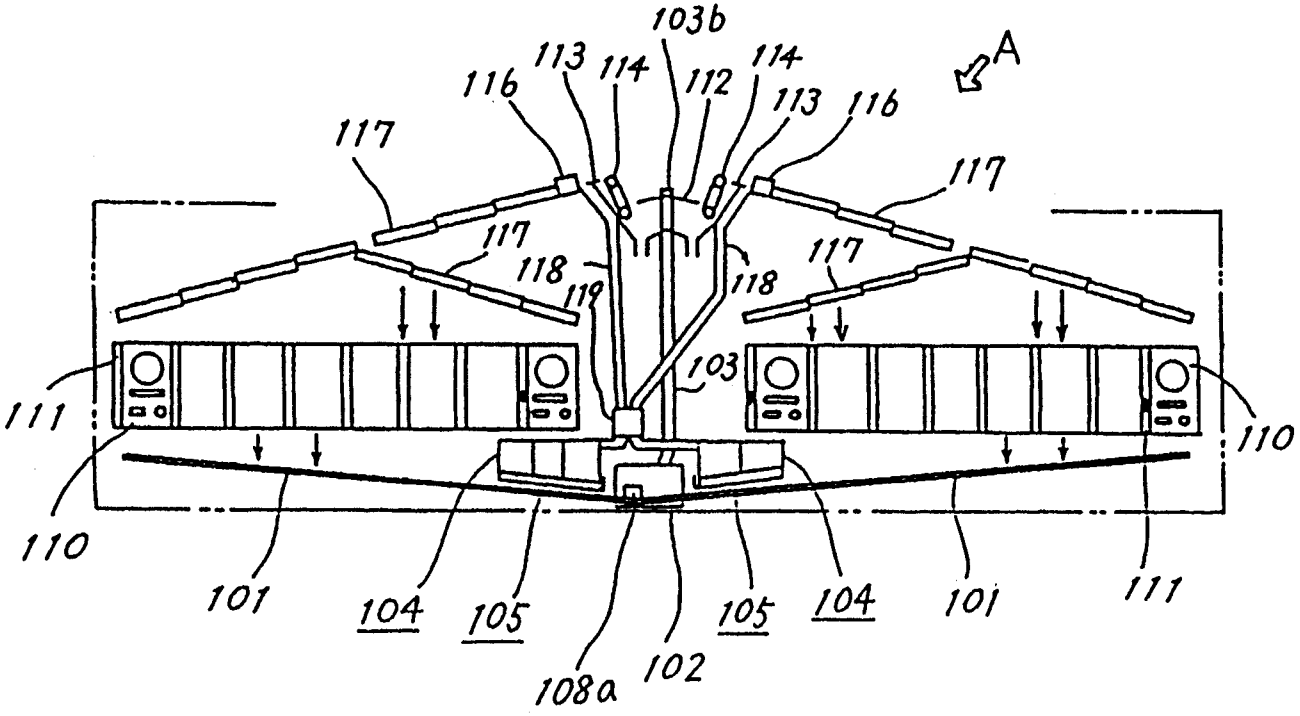
FIG. 2 is a fragmentary front view of a pachinko island.
Figure 3:
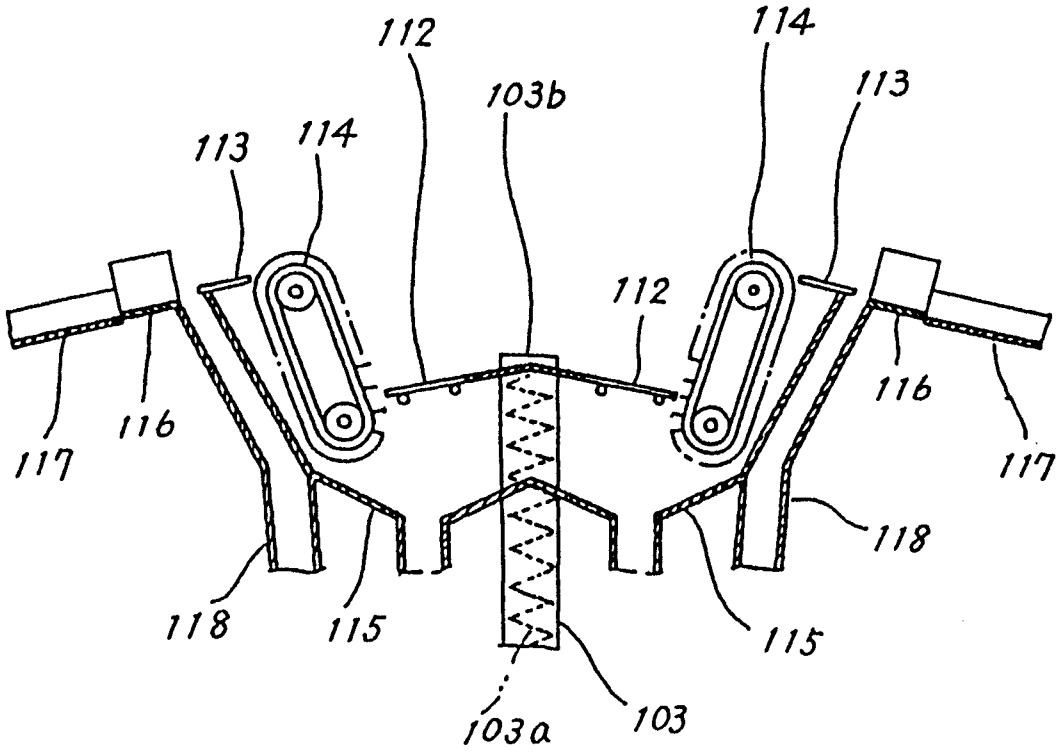
FIG. 3 is a fragmentary enlarged front view of FIG. 2.

FIG. 2 shows a main portion of a pachinko island A, in which a multiplicity of pachinko machines 110 and ball dispensers 111 are installed at both sides of the island. Centrally in the lower part of the pachinko island A, there is situated a lower tank 102 communicating with the downstream end of a collecting gutter 101 for collecting balls which failed scoring holes of the individual pachinko machines 110. Mounted on the lower tank 102 is a polishing and lifting device 103 in which a spiral member 103a is rotatably inserted. The polishing and lifting device 103 is equipped, on each side of an upper outlet 103b thereof, with upper and lower drainboards 113, 112 for brushing off the polishing material mixed with pachinko balls, and a rotary lift 114 for lifting pachinko balls. Under the respective lifts 114, 114, there is located a pair of polishing-material collecting gutters 115, 115 communicating at their lower ends with the lower tank 102.

A distribution gutter 117 for distributing pachinko balls to the individual pachinko machines 110 and the individual ball dispensers 111 extends slantedly from a gutter plate 116 at the lower side of the respective upper drainboard 113. Downwardly between the respective drainboard 113 and the associated gutter plate 116. there is an overflow tube 118 extending vertically for allowing overflow pachinko balls to flow downwardly.

A pair of reserve tanks 104, 104 is situated on opposite sides of the lower tank 102, extending on and along respective slanted collecting gutters 101, 101. The leftside reserve tank 104 is divided into three longitudinally successive pairs of tank parts **104*a*, 104*b*; 104*c*, 104*d*; 104*e*, 104*f*, i.e. six tank parts in total, the tank parts of each pair being arranged in transverse alignment with one another. The rightside reserve tank 104 is divided into two longitudinally successive pairs of tank parts 104*a*, 104*b*; 104*c*, 104*d*, i.e. four tank parts in total, the tank parts of each pair being arranged in transverse alignment with one another. The slanted reserve tank 104 has on its upper surface a pair of slanted supply grooves 107, 107 extending longitudinally on and along the individual tank parts and communicating with the individual tank parts via supply holes 106 in the upper surface of the reserve tank 104. The two supply grooves 107, 107 are connected at their upstream ends to the respective downstream ends of a pair of distribution gutters 120, 120 extending in opposite directions from a case 119 communicating with the lower portions of the overflow tubes 118, 118**.

Figure 6B:
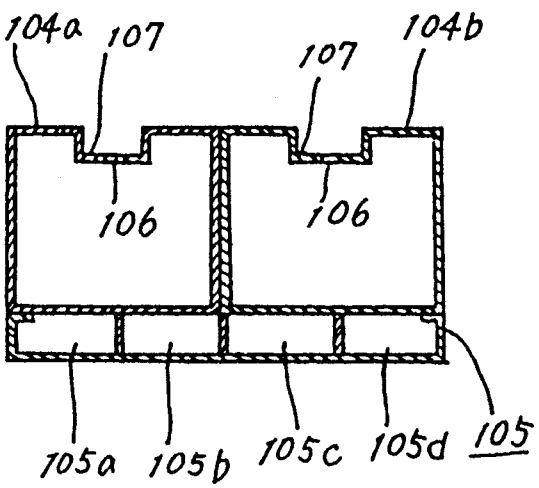
FIG. 6 is a cross-sectional view taken along line I—I of FIG. 5.
Figure 6A:
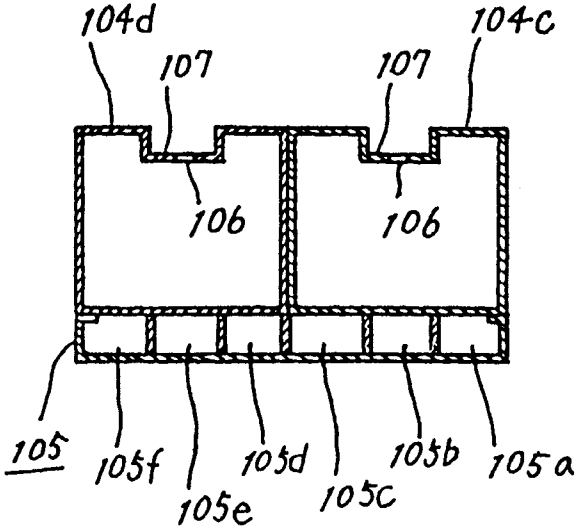
Figure 7B:
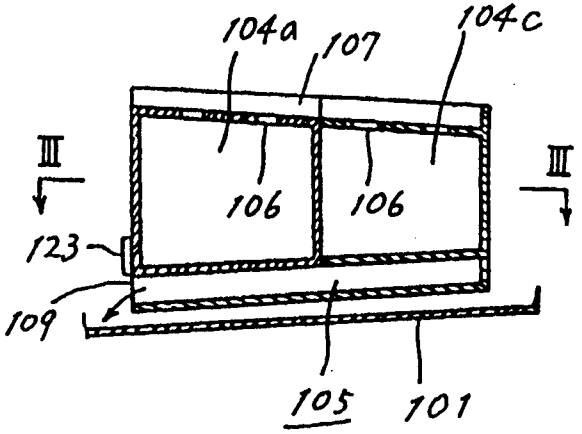
FIG. 7 is a cross-sectional view taken along line II—II of FIG. 5.
Figure 7A:
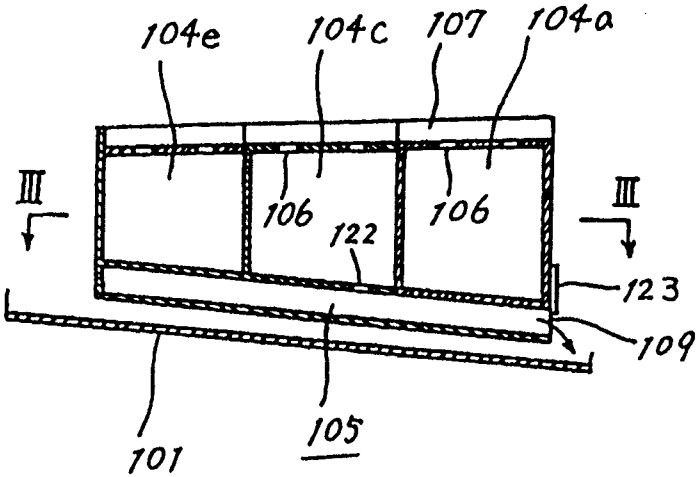
Figures 8A, 8B:
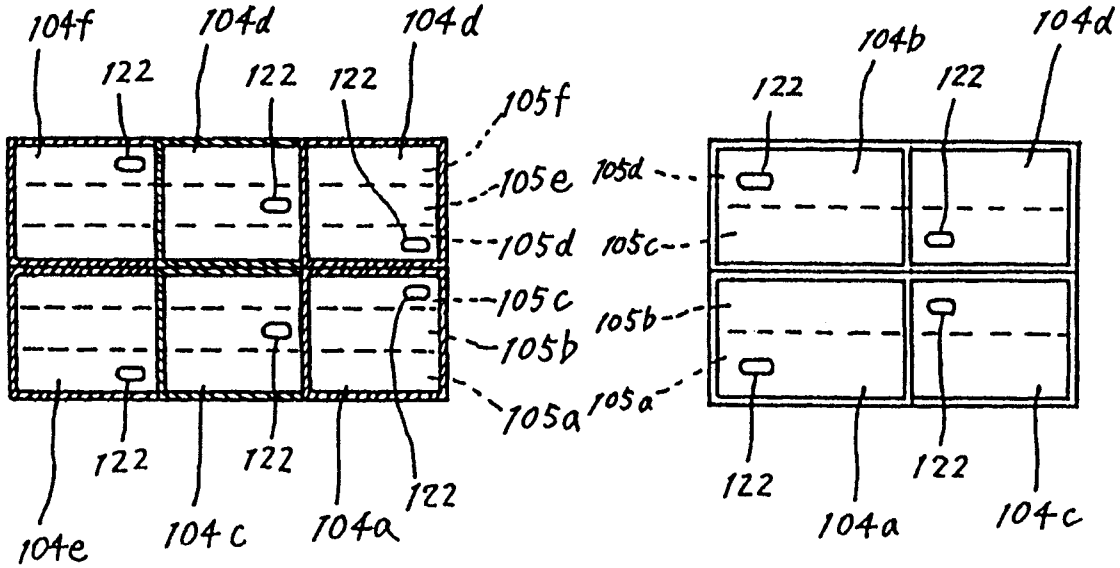
FIG. 8 is a cross-sectional view taken along line III—III of FIG. 7.
Figure 9:
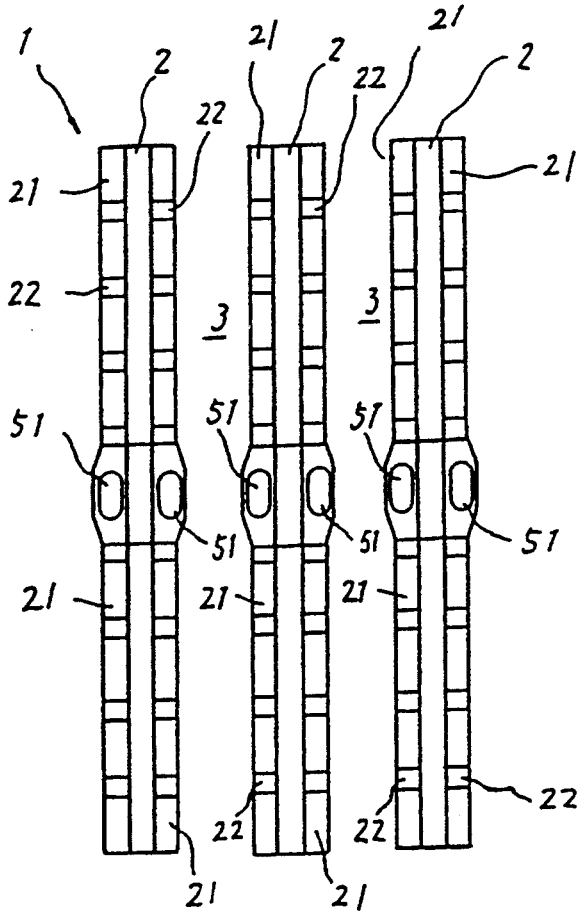
FIG. 9 PRIOR ART
FIG. 9 is a schematic plan view of a known amusement arcade in which pachinko islands are arranged.
Figure 10:
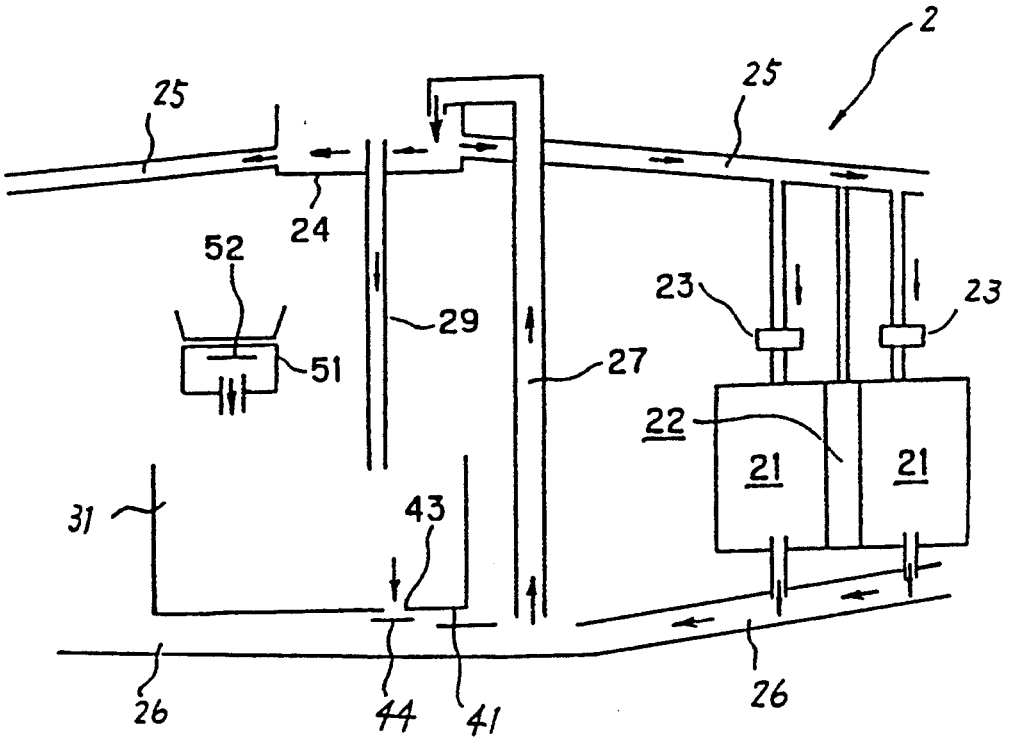
FIG. 10 PRIOR ART
FIG. 10 is a schematic cross-sectional view of the known pachinko island.

Further, each reserve tank 104 has on its underside a lower gutter 105 extending over and along the collecting gutter 101. The lower gutter 105 has in opposite surfaces a pair of slots 121, 121 for maintenance purposes, as shown in FIG. 4. The leftside lower gutter 105, as shown in FIG. 6, is divided into three longitudinally successive pairs of gutter parts **105*a*, 105*b*; 105*c*, 105*d*; 105*e*, 105*f*, i.e. six gutters parts in total, the gutters parts of each pair being transverse aligned with one another. The rightside lower gutter 105 is divided into two longitudinally successive pairs of gutter parts 105*a* 105*b*; 105*c*; 105*d*, i.e. four gutter parts in total, the gutter parts of each pair being transversely aligned with one another. Each tank part 104*a*–104*f* has in its bottom surface at the downstream end thereof a discharge hole 122 opening over the respective gutter part 105*a* 105*f*, as shown in FIG. 8. The downstream discharge hole 109 of each gutter part 105*a*-105*f* has an is opening over the branched portions 101*a*, 101*b* of the two collecting gutters 101, 101 communicating with a pair of supply holes 108*a*, 108*b* at opposite sides of the lower tank 102. There is located at each discharge hole 109 a shutter 123** operable upon receipt of a signal.

With this arrangement, when the pachinko balls fallen from the two overflow tubes 118, 118 to enter the case 119 they are supplied into the individual tank parts **104*a*-104*f* via the respective supply holes 106 for storage, flowing in the supply grooves 107. Since the bottom surface of each of the tank parts 104*a*–104*f* is narrow and slant, the pachinko balls in the individual tank parts can be discharged downwardly to the respective gutter parts 105*a*-105*f* via the discharge holes 122 smoothly without bridging. Therefore, when the shutter 123 is opened, the pachinko balls are discharged onto the branched portions 101*a*, 101*b* of the collecting gutter 101 from the individual discharge holes 109 so that they can be supplied into the lower tank 102** effectively.

As described above, according to this invention, when the pachinko balls overflown from the upper part of the island are supplied to the supply grooves on the reserve tank 104, they will be supplied into the individual tank parts 104a–104f from the respective supply holes 106 for storage. Since the bottom surface of the individual tank part 104a–104f is narrow and slant, all of the pachinko balls in the individual tank parts 104a–104f can be discharged downwardly to the respective gutter parts 105a–105f smoothly without bridging: which would have been caused with the conventional art. Thus as the pachinko balls can be supplied to the lower tank 102 from the individual gutter parts 105a–105f via the collecting gutter 101, the reserve tank performs effective ball management in the island, guaranteeing streamlined circulation of all pachinko balls in the island, without causing any dead balls staying in the lower part of the tank and tending to be rusted, which would have been caused with the conventional arrangement.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An improved structure for storing pachinko balls and supplying the stored pachinko balls to a pachinko island as needed, comprising:

a lower tank located in a lower part of the pachinko island for storing the pachinko balls;

ball polishing and lifting means, mounted on the lower tank, for polishing and lifting to an upper level of the pachinko island balls from the lower tank;

a collecting gutter mounted at a slant in the lower part of the pachinko island, communicating with the lower tank;

a reserve tank for holding some of the pachinko balls in reserve, divided into a plurality of tank parts defined by dividing walls and arranged on a plane, with each of said tank parts having a respective inclined bottom surface; and under the entire reserve tank, an inclined lower gutter which communicates with the inclined bottom surfaces of the tank parts and with the collecting gutter.

2. The structure according to claim 1, wherein:

said lower gutter is divided transversely into a plurality of gutter parts which respectively communicate with the inclined bottom surfaces of said tank parts.

3. The structure according to claim 2, wherein:

the collecting gutter has a branched form with branches thereof communicating with each other at a location that is substantially central with respect to the lower tank, said branches being disposed on front and back sides of the lower tank;

wherein each of said gutter parts has an inclined lower outlet adapted to be located above and in communication with the branches of the collecting gutter; and wherein supply ports are provided at the front and back sides of the lower tank and in communication with corresponding branches of the collecting gutter.

4. The structure according to claim 1, wherein:

said reserve tank comprises a pair of identical reserve tank parts which are adapted to be located above respective collecting gutters on opposite sides of the lower tank, the reserve tank parts each being composed of one half of said tank parts and being disposed on opposite sides of the lower tank.

5. The structure according to claim 4, further comprising:

overflow pipes for respectively conducting any pachinko balls that have overflowed at the upper portion of the pachinko island to the reserve tank parts.

6. The structure according to claim 1, wherein:

said tank parts being arranged as a plurality of elongate pairs of tank parts disposed in a longitudinal sequence in two lines along the collecting gutter, said tank parts of each pair being arranged transversely relative to said longitudinal sequence.

7. The structure according to claim 1, further including:

a longitudinally inclined supply groove disposed below the tank parts and having a plurality of supply holes communicating with the respective tank parts located thereabove.

8. The structure according to claim 1, wherein:

said lifting device comprises means for polishing pachinko balls.

9. The structure according to claim 8, wherein:

said means for polishing comprises means for mixing an abrasive material with the lifted pachinko balls.

10. The structure according to claim 9, further comprising:

means for separating the abrasive material from the lifted pachinko balls, located at an upper portion of the pachinko island.

11. The structure according to claim 10, further comprising:

means for conveying separated abrasive material to the lower tank.

12. The structure according to claim 10, wherein:

said lower gutter is divided transversely into a plurality of cooperating gutter parts which respectively communicate with the bottom surfaces of said tank parts.

13. The structure according to claim 10, wherein:

said reserve tank comprises a pair of identical reserve tank parts which are adapted to be located above respective collecting gutters at each side of the lower tank, the reserve tank parts each being composed of one half of said tank parts and being disposed on opposite side of the lower tank.

14. A pachinko ball circulating system for use with a pachinko island wherein a plurality of pachinko machines are arranged for circulating pachinko balls in said pachinko island, comprising:

a lower tank provided at a first lower portion of the pachinko island for temporarily saving pachinko balls to be used in the pachinko machines;

a lifting device for lifting the pachinko balls saved in said lower tank to an upper portion of the pachinko island to send the balls to the pachinko machines;

at least one collecting gutter arranged below and along the pachinko machines for receiving pachinko balls discharged therefrom and sending the received pachinko balls to said lower tank;

a reserve tank, provided at a second lower portion of the pachinko island and above said at least one collecting gutter, for saving and discharging the pachinko balls to control a supply of the pachinko balls to be used in the pachinko island; and an overflow pipe for conducting any pachinko balls that have overflowed at the upper portion of the pachinko island to said reserve tank, said reserve tank including a plurality of individual tank parts defined by dividing walls and each having a slanting base, and a lower gutter provided below said tank parts for conducting pachinko balls discharged from said tank parts to said at least one collecting gutter.

15. A pachinko ball circulating system as defined in claim 14, wherein:

said reserve tank further includes a shutter which closes when the pachinko balls being used in the pachinko island exceed a selected number, and opens when the number of pachinko balls being used falls below the selected number.

16. A pachinko ball circulating system as defined in claim 15, wherein:

said shutter is provided at one end of said lower gutter.

17. A pachinko ball circulating system as defined in claim 15, wherein:

a base of each of said tank parts is provided with a respective hole to communicate with said lower gutter.

18. A pachinko ball circulating system as defined in claim 17, wherein: said bases of the tank parts are disposed to be in a common plane, and said tank parts are individually defined by dividing a single tank.

19. A pachinko ball circulating system as defined in claim 14, wherein:

said lower tank and said lifting device are provided substantially at a center of the pachinko island; and said at least one collecting gutter is provided at each side of said center.

20. A pachinko ball circulating system as defined in claim 19, further comprising:

distribution gutters provided at the upper portion of the pachinko island and at opposite sides of the center thereof, for respectively distributing the pachinko balls lifted by said lifting device to each pachinko machine.

21. A pachinko ball circulating system as defined in claim 20, wherein:

a polishing and lifting device is used as said lifting device to lift up the pachinko balls while polishing them by mixing with abrasives, and further comprising a separating mechanism provided between said polishing and lifting device and the distribution gutters located at opposite sides of the pachinko island, for separating the lifted pachinko balls from the abrasives.

22. A pachinko ball circulating system as defined in claim 20, further comprising:

at least one overflow pipe provided to correspond to each of said distribution gutters.

23. A pachinko ball circulating system as defined in claim 22, wherein:

said reserve tank comprises reserve tank portions provided at each side of said lower tank, and respective overflow pipes are connected to said reserve tank portions.

24. A pachinko ball circulating system as defined in claim 19, wherein:

said reserve tank comprises reserve tank portions provided at each side of said lower tank, corresponding to each of said at least one collecting gutter.

* * * * *